United States Patent [19]

Cook et al.

[11] 4,200,080

[45] Apr. 29, 1980

[54] AUTOMATIC STARTING SYSTEM

[76] Inventors: Norman E. Cook, 9025 Broken Arrow Rd., Indianapolis, Ind. 46234; William L. Kirby, 1160 W. Cedar Bluff, Bloomington, Ind. 47401

[21] Appl. No.: 924,491

[22] Filed: Jul. 14, 1978

[51] Int. Cl.[2] ..... F02N 15/00

[52] U.S. Cl. ..... 123/179 BG; 123/179 G; 290/38 R

[58] Field of Search ..... 123/179 B, 179 BG, 179 G; 290/38 R, DIG. 3

[56] References Cited

U.S. PATENT DOCUMENTS

| | | | |
|---|---|---|---|
| 2,698,391 | 12/1954 | Braden | 290/2 |
| 2,748,759 | 6/1956 | Schiffler | 123/179 B |
| 2,836,732 | 5/1958 | Newlin | 290/38 |
| 2,975,296 | 3/1961 | Dominguez-Rego | 290/37 |
| 3,078,834 | 2/1963 | Wright | 290/DIG. 3 |
| 3,357,417 | 12/1967 | Baumann | 123/179 BG |
| 3,455,403 | 7/1969 | Hawthorne | 290/DIG. 3 |
| 3,530,846 | 9/1970 | Bean et al. | 123/179 BG |
| 3,633,040 | 1/1972 | Baxter | 290/DIG. 3 |
| 3,696,333 | 10/1972 | Mott | 290/DIG. 3 |
| 3,859,540 | 1/1975 | Weiner | 123/179 BG |
| 4,080,537 | 3/1978 | Bucher | 123/179 B |

*Primary Examiner*—Ira S. Lazarus
*Assistant Examiner*—Andrew M. Dolinar
*Attorney, Agent, or Firm*—Woodard, Weikart, Emhardt & Naughton

[57] ABSTRACT

An automatic starting system for the internal combustion engine of a vehicle includes a settable clock device in parallel with a remote control receiver, a plurality of relays and timed, thermal switches, a thermal switch flasher and a solenoid coupled to the throttle-gas pedal linkage of the vehicle. The relays and timed, thermal switches are arranged to couple current from the battery of the vehicle to the starter and to provide a variety of circuit paths depending upon the particular conditions existing within the vehicle. The flasher alternately energizes and deenergizes the solenoid which is mechanically coupled to pump the gas pedal when the engine is cold, before the time that battery current is coupled to the starter. A number of safety features such as a hood safety switch, an overspeed switch, a temperature switch and a low oil pressure switch, are provided in order to prevent damage to the vehicle and to prevent injury to others.

26 Claims, 5 Drawing Figures

AUTOMATIC STARTING SYSTEM

BACKGROUND OF THE INVENTION

This invention relates in general to electronic devices and in particular to such devices arranged as an automatic starting system for vehicles.

Automatic starting systems for vehicles represent an attempt by man to simplify a manual activity by the use of electronics. The object quite simply is to enable an individual to start a vehicle either by clock means at a preselected time of day and/or from a remote location at any desired time by the use of remote control transmitter-receiver means. The following listed patents disclose certain circuit arrangements which have been conceived in an attempt to provide improvements to automatic starting systems.

| U.S. Pat. No. | Patentee | Issue Date |
|---|---|---|
| 2,698,391 | Braden et al. | 12/28/54 |
| 2,748,759 | Schiffer | 6/05/56 |
| 2,836,732 | Newlin | 5/27/58 |
| 2,975,296 | Dominguez-Rego | 3/14/61 |
| 3,696,333 | Mott | 10/03/72 |

Braden et al. discloses an engine-control system whereby an engine may be started and stopped automatically under the control of a clock mechanism. Also provided are means to start and stop the engine under certain temperature conditions.

Schiffer discloses an automatic starting device for an internal combustion engine which incorporates a timing mechanism for starting a car at a speed somewhat above idling speed and reducing the speed to the correct idling speed when the proper vehicle temperature is reached.

Newlin discloses an automatic car starter for automatically starting a motor vehicle at a predetermined time and energizing the motor vehicle heater at the predetermined time, whereby the automobile engine and the interior of the automobile will have had sufficient time to warm up when the operator enters the vehicle.

Dominguez-Rego discloses a clock-control circuit for energizing the ignition circuit of a vehicle, the starter and the heater and for controlling the throttle opening during the starting and warm-up periods. The circuit deenergizes the starter once the engine has started and restarts the engine if it stalls while warming up or idling.

Mott discloses an automatic automobile starter which permits utilization of either a clock-switching mechanism or a radio remote control switching system to supply current to the starter motor. Current is supplied to the ignition coil through an oil pressure switch to insure that the engine will not start unless there is sufficient oil pressure.

None of these disclosed devices or systems disclose means by which the gas pedal may be pumped prior to current being coupled to the starter which is the vehicle manufacturer's recommended way to start most vehicles which have a cold engine. In addition, none of the disclosed devices or systems include sufficient safety features to virtually eliminate any type of damage to the vehicle or injury to others. For example, if an overspeed condition would result, such as by a child playing with the gas pedal of the started and still unattended vehicle, there are no disclosed means to turn off the engine automatically. Similarly, if a child would attempt to raise the hood when the vehicle is being, or has already been, remotely started, then without some type of interlock switch to turn off the engine, the child could be injured. Furthermore, none of the disclosed devices or systems provide means for remote-control turn off of the vehicle once it has been started.

SUMMARY OF THE INVENTION

An automatic starting system for a vehicle internal combustion engine according to one embodiment of the present invention comprises system energizing means electrically connectable to the battery of the vehicle and selectively actuatable for conducting a current signal from the battery, a plurality of switch means for coupling the current signal to the starter circuit of the vehicle, solenoid means connectable to the throttle-gas pedal linkage of the vehicle and means for alternately energizing and deenergizing the solenoid means for a finite time interval thereby creating a pumping action of the throttle-gas pedal linkage.

One object of the present invention is to provide an improved automatic starting system for the internal combustion engine of a vehicle.

Related objects and advantages of the present invention will be apparent from the following description.

DESCRIPTION OF THE PREFERRED EMBODIMENT

Figure 1:
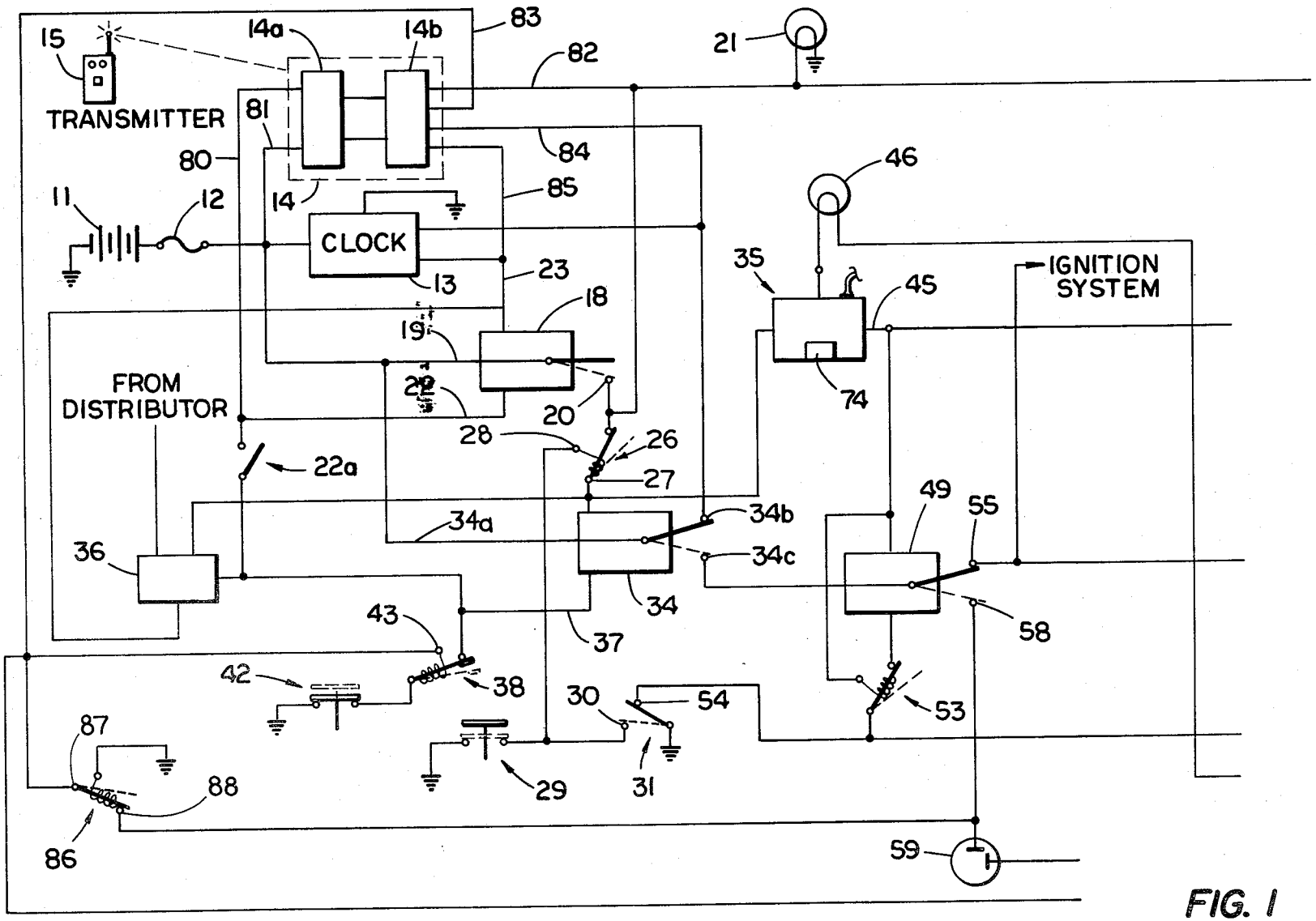
FIGS. 1 and 1*a* in combination are a schematic diagram of an automatic vehicle starting system according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1A:
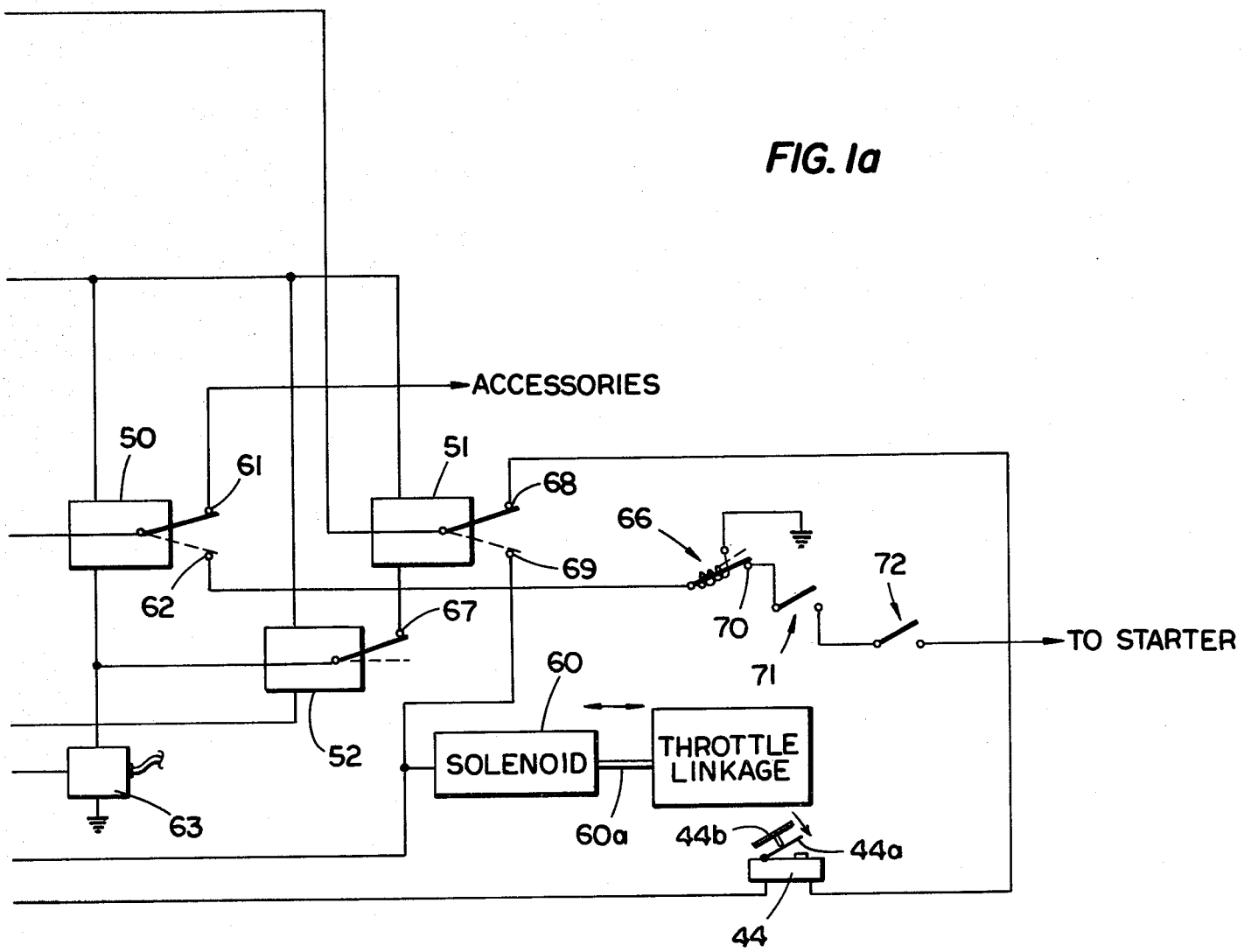

Referring to FIGS. 1 and 1*a*, which are to be oriented in end-to-end relationship, there is illustrated in diagrammatic and schematic form automatic starting system 10 which is designed for the preselected timed starting as well as the remote starting of the internal combustion engine of a vehicle, such as, for example, an automobile. Vehicle starting power is supplied by the vehicle battery 11 which also provides the requisite power to system 10. The battery is coupled through a fuse 12 to a settable clock 13 which is in parallel with a remote control receiver circuit section 14. Circuit section 14 includes a remote-control receiver switch 14*a* which is compatible with a suitable transmitter and a double-pole, single-throw relay 14*b*. Clock 13 may be set to a desired time of day and when that time is reached, the vehicle will be automatically started as will be described hereinafter. Alternatively, the vehicle may be automatically started by means of a remote, hand-held transmitter 15 which is capable of closing receiver switch 14*a* by transmitting a particular frequency signal, as is well known in the art. It is to be anticipated that starting system 10 may be provided with either receiver circuit section 14 or clock 13 or both.

Figure 2:
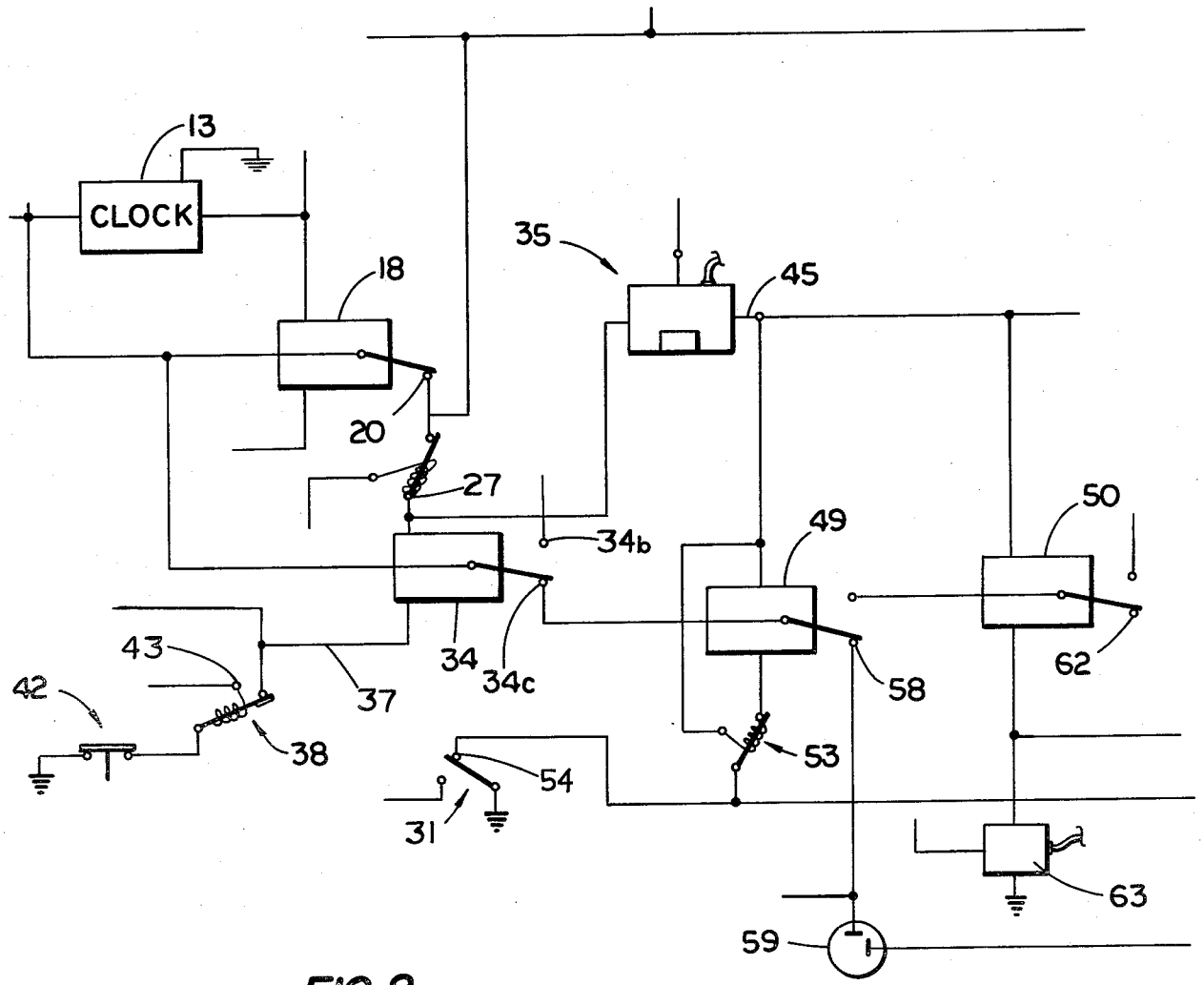
FIGS. 2 and 2*a* in combination are a partial schematic diagram of one particular circuit path arrangement of the FIG. 1 system corresponding to one set of vehicle conditions.
Figure 3:
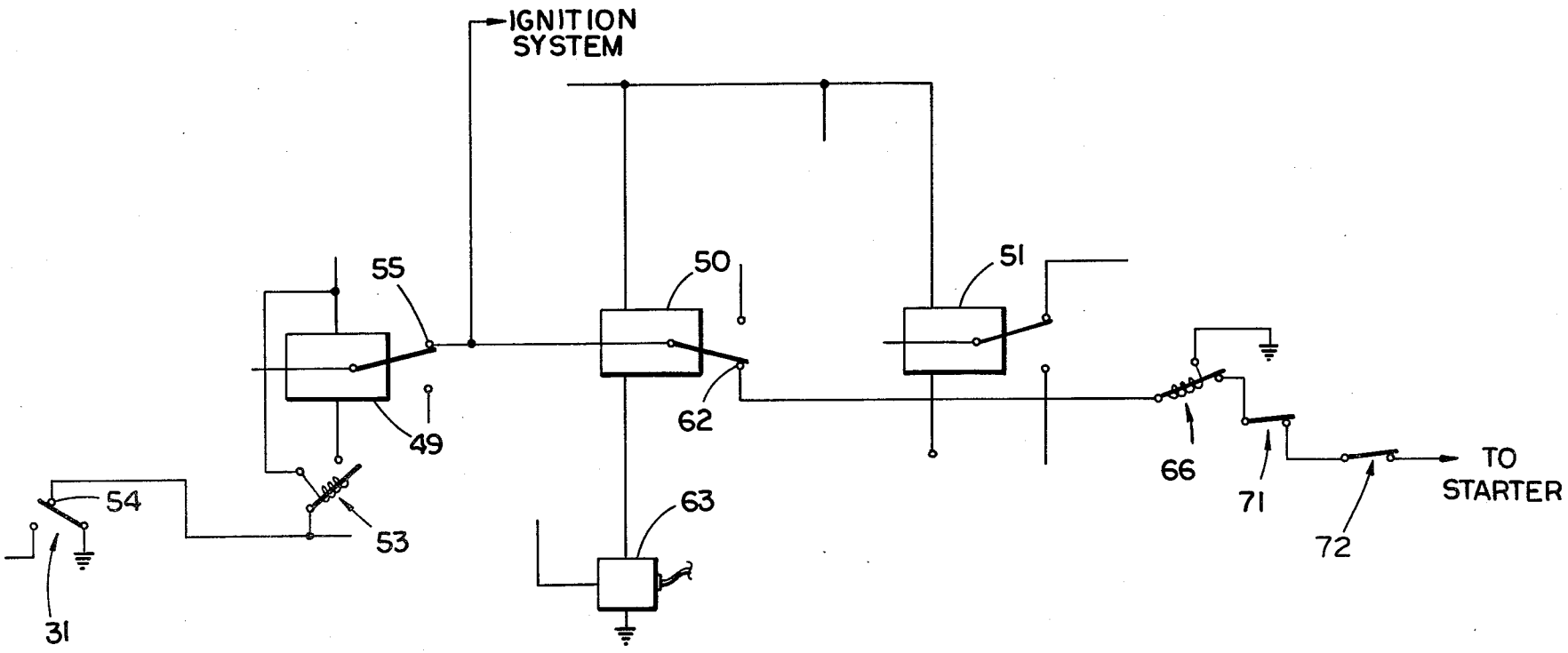
FIG. 3 is a partial schematic diagram of another circuit path arrangement of the FIG. 1 system corresponding to a different set of vehicle conditions.

Relay 18 is a normally-open, single-pole, single-throw, latching relay, which, when energized, connects battery power (current) on line 19 to terminal 20 which will energize light 21 as well as provide power to other points in system 10. The various relays illustrated in FIGS. 1, 2 and 3 are shown as two-position relays with the solid line representing their normally deenergized position and the broken line indicating the position of the relay arm when the relay is energized. For relay 18 to be energized, two input signals are required. First, there must be a ground signal provided on line 22 by means of key switch 22*a* and secondly a suitable current signal through line 23 from battery 11 by way of either clock 13 or receiver circuit section 14. In order to prevent continued, unattended running of the vehicle's engine, relay 18 is a latching relay which will open after a particular interval of time, such as ten minutes, thereby shutting off the engine. The fact that relay 18 is a latching relay means that a momentary transmitter signal will be sufficient to actuate the receiver and energize the relay. When a clock device is used, it has only a 5-second run interval and relay 18 remains a latching relay. However, due to the system operation advantages provided by receiver relay 14*b*, as will be described in greater detail hereinafter, it is preferred that receiver circuit section 14 be included. The fact that relay 18 will open after a preselected interval of time provides a safety precaution feature which guards against the engine running for extended periods of time due to inadvertent turn-on of the system or the inability to turn off the system after intentional turn-on. A further safety precaution is provided by key switch 22*a* which is a two-position, key-operated, ON/OFF switch. Key switch 22*a* must be closed, thereby providing the necessary ground signal to relay 18 and to receiver switch 14*a*, in order for relay 18 to be energize upon the receipt of a suitable power (current) signal through either clock 13 or through receiver circuit section 14. Thus, if key switch 22*a* is left open, the system cannot be turned on. Key switch 22*a* may be mounted either internally or externally to the vehicle.

Switch 26 is a timed, thermal switch which is normally closed thereby coupling terminal 20 to terminal 27. This switch will remain closed and conductive throughout the engine turn-on and warm-up period unless a ground signal is received at terminal 28 from either the low oil pressure switch 29 or from the hot terminal 30 of engine temperature switch 31. When a ground signal is received, switch 26 will heat up within a certain preselected interval of time such as, for example, twenty seconds, and will then open, thereby breaking the contact between terminals 20 and 27 and disconnecting the current signal from other portions of the circuit as will be described hereinafter. Terminal 27 is coupled to relay 34, vacuum switch 35 and overspeed switch 36. Relay 34 is a normally-open, single-pole, double-throw relay and when energized, relay 34 switches from contact with terminal 34*b* to contact with terminal 34*c* thereby coupling battery power (current) on input line 34*a* to terminal 34*c*. Terminal 34*b* connects to clock 13 and to the relay 14*b* portion of receiver circuit section 14. Relay 34 is energized by the presence of a ground signal on line 37 from switch 38 and battery power from terminal 27 by way of switch 26 and relay 18. Under normal conditions, timed, thermal switch 38 will be closed as will hood safety switch 42, and a ground signal will be provided to relay 34. However, if the hood of the vehicle is opened before, during or after the automatic turn-on cycle of system 10, switch 42 will open removing the ground signal from relays 34 and 18, preventing coupling to terminal 34*c*. Similarly, when an overspeed condition is sensed, based on engine RPM's, a ground signal from overspeed switch 36 immediately is coupled to line 23 and in turn to relay 18. This ground signal causes relay 18 to disengage thereby removing battery power from the remainder of system 10.

Line 37 represents a common ground line for several components of system 10, such as key switch 22*a*, overspeed switch 36 and relay 34. Conventional ground symbols are used with all other components and this conventional symbol represents chassis ground.

Terminal 43 is shown as being connected to switch 44, and it is to be understood that either switch 36 or 44 may be used to indicate overspeed conditions. However, both switches would not normally be incorporated within the same system. However, both switches are illustrated in FIG. 1 for the purposes of drawing clarity and to illustrate their circuit positions. Switch 36 is an electronic overspeed switch which is set to a preselected engine RPM level, such as 3,500 RPM's, and is electrically tied in with the vehicle distributor. In the event the throttle linkage would stick or the gas pedal would be inadvertently depressed, such as by a child, then once the engine RPM level exceeds the preselected level, the ground signal causes relay 18 to disengage. The ultimate effect of this is that the vehicle engine will be turned off by the removal of battery power.

In the event mechanical overspeed switch 44 is used, a current signal from relay 51 will be coupled to terminal 43 of switch 38 by switch 44. This current signal causes switch 38 to heat up and open. The time interval for such opening action is approximately six seconds and once open, the requisite ground is removed from relay 34 which returns the arm of relay 34 into contact with terminal 34*b*. Switch 44 is a mechanical switch and it includes a lever arm 44*a* which is mechanically tied in with the gas pedal 44*b* of the vehicle and, as before with electronic overspeed switch 36, if the gas pedal is inadvertently depressed after the engine has started, switch 44 will be closed thereby providing the requisite current signal to terminal 43 for turn-off of the engine.

Vacuum switch 35 is a single-pole, double-throw switch which has a normally-closed terminal coupled to line 45 and normally-open terminal coupled to light 46. During initial system turn-on, current from battery 11 is supplied by way of line 45 to one side of relays 49, 50, 51 and 52 and to timed, thermal switch 53. Vacuum switch 35 is set at a vacuum level slightly higher than the starter of the vehicle is capable of producing. Consequently, current continues to be delivered to the four relays and to switch 53 until the engine starts, at which time the vacuum level of the vehicle will be sufficient to change the state of switch 35. The normally-closed terminal of switch 35 is opened and the normally-opened terminal closes. The current path to the four relays and switch 53 is opened while light 46 now receives current and illuminates, assuming the presence of a ground signal to complete the circuit path, indicating that the engine is running. If, for some reason, light 46 would be off or would not turn on in response to engine start-up, then it would be an indication that there was a malfunctioning portion within the circuit and it would serve as a warning indicator to the operator that something needs to be either repaired or replaced. Switch 53 is a normally-closed, timed, thermal switch which provides a ground connection from the cold terminal 54 of switch 31 to the ground side of relay 49. This switch allows engagement of relay 49 for a selected, short interval of time, such as 4 seconds. After this interval of time, switch 53 opens and remains open until the system is reset for another start cycle attempt. Relay 49 is a single-pole, double-throw type relay which connects to terminal 55 in the disengaged mode of operation and to terminal 58 when engaged by the presence of a suitable ground signal and a suitable current signal. Due to switch 53, relay 49 will first be connected to terminal 55 and then to terminal 58 for four seconds and will then reconnect to terminal 55. Terminal 55 connects to the ignition system of the vehicle and to relay 50. Also envisioned as part of this invention is the inclusion of a double-throw, double-pole relay connected between terminal 55 and ground. This relay is operable to disconnect the ignition switch of the vehicle from the ignition system and thereupon to connect the battery to the ignition system.

Terminal 58 of relay 49 connects to current interrupt, thermal switch flasher 59 which in turn couples to solenoid 60. Flasher 59 provides pulses of power to solenoid 60, during the 4-second interval that relay 49 is engaged. These pulses of power cause linear reciprocating motion of piston **60*a* which creates a pumping action to the throttle-gas pedal linkage of the vehicle to which piston 60*a* is mechanically coupled. As flasher 59 heats up, current is provided to solenoid 60. When a particular temperature is reached within flasher 59, flasher 59 opens and becomes nonconductive as it begins to cool. When a second, lower temperature is reached, flasher 59 again becomes conductive and this conductive-nonconductive cycle repeats rapidly. The repetitive frequency of the on/off/on/off cycling of flasher 59 depends upon the particular model and style of flasher selected and the number of gas pedal pumps which occur during the single 4-second interval that relay 49 is coupled to terminal 58 may range from a single pump to as many as five or six. Solenoid 60** may be mounted beneath the hood or dashboard of the vehicle and may be coupled to the throttle linkage by any one of a number of suitable coupling techniques. This gas pedal pumping action is unique in that, in addition to simulating normal vehicle starting procedure requirements, the pumping action occurs before engagement of the starter and provides a precharge of fuel and sets the automatic choke. At the present time, on most current model automobiles, automobile manufacturers are recommending that in order to start the car when the engine is cold that the gas pedal should be pumped before the starter is attempted to be energized. Inasmuch as many of these current model cars will not start in cold weather unless this recommended procedure is followed, it is important that the gas pedal be pumped before current is coupled to the starter.

Relay 50 is a single-pole, double-throw device contacting terminal 61 in the normally-closed, up position and contacting terminal 62 when in the engaged, down position. Relay 50 becomes energized (engaged) upon receiving a suitable power signal through switch 35 and the ground signal from a second vacuum switch 63. Switch 63 may be, for example, a single-pole, double-throw device set at a vacuum level which is slightly higher than the starter of the vehicle can produce. In the normally-closed, disengaged position, switch 63 conducts a ground signal to relay 50 and relay 52, and when engaged, the normally-closed position opens and removes the ground signal from relays 50 and 52 and the normally-open position closes coupling the ground signal to light 46. This provides the necessary ground signal to complete the circuit for the illumination of light 46. When energized, relay 50 couples battery power (current) to timed, thermal switch 66 which is associated with the vehicle starter circuit. When the engine starts, the engine vacuum level causes both switches 35 and 63 to open which removes the current signals to relay 49, switch 53, relay 50, relay 51 and relay 52, as well as removing the ground signal from relay 50 and relay 52. This returns relay 50 to its up position, thereby coupling battery power to other vehicle accessory items such as an air conditioner or heater.

Relay 52 may be either a single-pole, single-throw or a single-pole, double-throw device with a normally closed position contacting terminal 67 and coupling the ground signal from switch 63 to relay 51. When energized (engaged), relay 52 opens, thereby removing the ground signal from relay 51. Relay 52 is used to prevent the operation of relay 51 when the vehicle engine is cold. When the engine is cold, relay 52 will receive a ground signal from switch terminal 54 of switch 31 and with a suitable current signal coupled to relay 52 by switch 35, relay 52 will engage and break contact with terminal 67 which prevents the requisite ground signal from reaching relay 51. Thus, relay 51 remains in its normally-closed, up position contacting terminal 68 and coupling to switch 44. In this manner, the only signal which solenoid 60 may receive is from flasher 59 and this assures the pumping of the gas pedal when the engine is cold. With engine temperature switch 31 installed in the cooling system or against the engine of the vehicle, the engine temperature can be sensed in an accurate manner and the arm of switch 31 will travel between the cold terminal 54 to the hot terminal 30 as engine temperature increases. However, the hot terminal 30 is actually indicative of an overheating condition and the terminal is provided as a safeguard inasmuch as the arm of switch 31 will only make contact with terminal 30 at a temperature which is above the normal operating temperature of an idling engine. At those intermediate temperatures between cold and hot, switch 31 will not contact either switch terminal, and relay 49 which is responsible for the pumping action of the gas pedal will be bypassed and relay 51 will be energized. Engaging (energizing) relay 51 causes the gas pedal to be depressed during the start cycle of a warm engine at the same time as current is being coupled to the starter. This corresponds to the recommended method of starting a warm engine rather than the pumping action which is required for a cold engine. Furthermore, when the engine is warm, a single depression of the gas pedal is sufficient and that is why the solenoid is only energized for one extension of the solenoid piston rather than an alternating energizing and deenergizing mode of operation. The signal from relay 51 at terminal 69 will be removed by the action of vacuum switches 35 and 63 upon engine start-up.

Switch 66 is a normally-closed, timed, thermal switch which couples terminal 62 to terminal 70 and park-neutral switch 71 which couples to emergency brake switch 72 which in turn couples to the starter (or starter relay) of the vehicle. Switch 66 is designed to limit the duration of current flow to the starter to approximately 11 seconds. If the engine fails to start within this time, switch 66 will open thereby cutting off current to the starter and also preventing battery drain. Shortly after this current cut-off occurs, switch 26, which may be set at a 20-second interval, for example, will also open thereby removing power from the other vehicle systems. Switch 66 is grounded to the chassis of the vehicle. In the event relay 50 would fail to return to its up position in contact with terminal 61 with ignition of the engine, then switch 66 would disengage current from the starter after 11 seconds. This provides a further safety feature for starting system 10. With standard transmission vehicles, the vehicle will start only in the neutral position and the emergency brake switch is provided to keep the vehicle from drifting or moving when idling in neutral. For automatic transmission vehicles, switch 72 may be eliminated or directly wired across so that the vehicle may be started by merely having the vehicle transmission set in the park position.

Restricter valve 74, which may be a part number VAC-8 offered by General Motors, or a suitable replacement part therefor, may be included as part of switch 35 or may be provided as a separate unit. Switches 35 and 63 provide for the immediate disengagement of the starter upon achieving a vacuum level above the preset level on the switches. Restricter valve 74 may be used to prevent the sudden reengagement of the starter when the engine dies and the vacuum level temporarily drops. Valve 74 provides a delay to the resetting of switch 35 so that the engine has time to come to a complete stop before the starter is allowed to reengage.

Figure 2A:
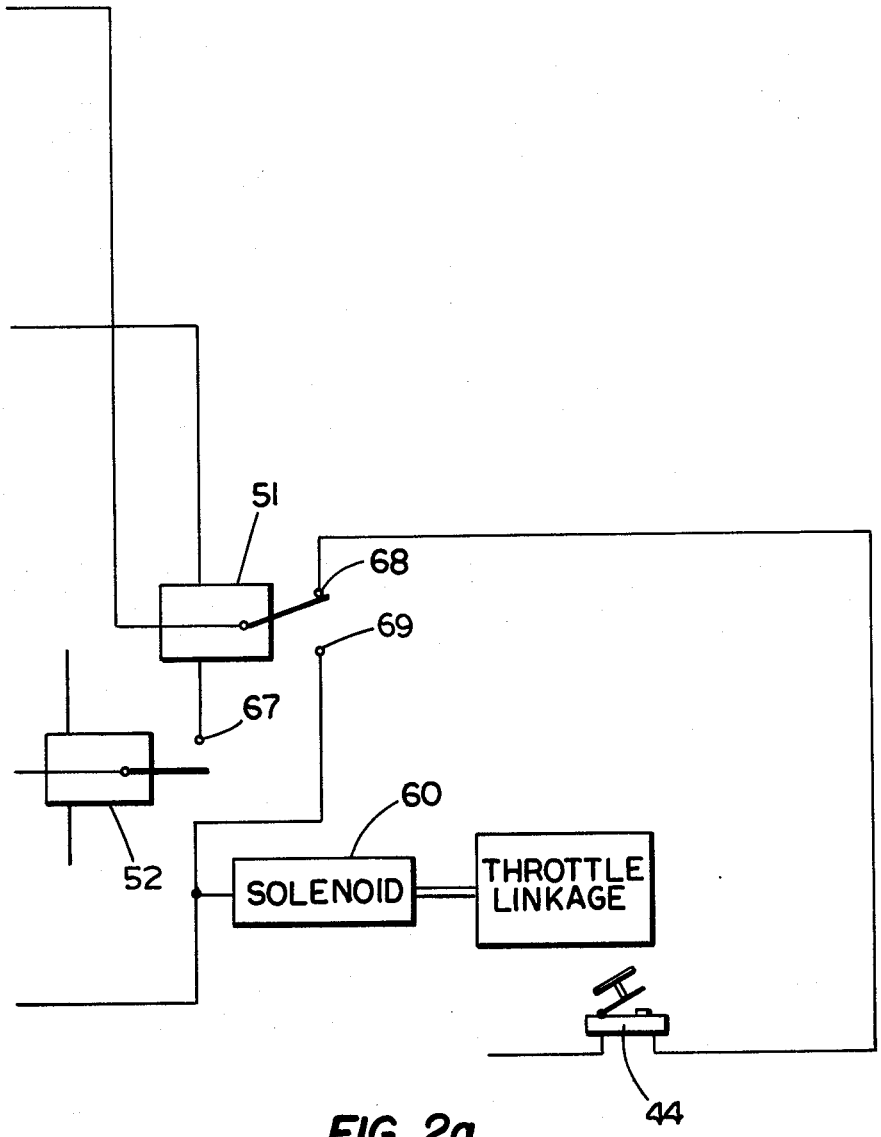

Inasmuch as an automobile, or similar vehicle operation is subject to numerous mechanical and environmental conditions, starting system is designed to account for such conditions while still providing a virtually fail-safe device. FIGS. 2 and 2*a* illustrate in partial schematic form the circuit connection which exists when the key switch 22*a* is closed and the engine is cold. FIGS. 2 and 2*a* may be properly connected by lining up the 5 lines at the end of FIG. 2 with the 5 lines at the side of FIG. 2*a*. As has been described, relay 49 will be energized for 4 seconds (governed by switch 53) and during this interval solenoid 60 will create a pumping action to the gas pedal. At the end of the 4 seconds, relay 49 returns to its normally-up position and couples battery power (current) to the ignition system and to relay 50 by way of terminal 55. Relay 50 will in turn couple battery power to the starter by way of switches 66, 71 and 72 as illustrated by FIG. 3 which represents FIG. 2, 4 seconds later in time.

One condition which may often occur at the time of start-up of a cold engine is that once started, the engine idle speed will be at a higher level than the normal idle speed. This may be corrected by one quick depression of the gas pedal. Consequently, system 10 is designed to convert a fast idle condition to a normal idle condition. Receiver circuit section 14 shows a total of six circuit lines connected to it. Lines 80 and 81 connect to receiver switch 14*a* while lines 82, 83, 84 and 85 connect to receiver relay 14*b*. As illustrated, line 80 connects to relay 18; line 81 connects to clock 13, relay 18 and relay 34; line 82 connects to terminal 20; line 83 connects to switch 38 and to timed, thermal switch 86; line 84 connects to clock 13 and terminal 34*b*; and line 85 connects to clock 13 and line 23.

Switch 86 receives input current at terminal 87 and is operable to conduct this current to terminal 88 and in turn to flasher 59. After approximately one second, the switch arm opens thereby removing current from flasher 59. However, for this one second interval, flasher 59 becomes operable and energizes solenoid 60 for the necessary one additional gas pedal depression required to change a fast idle condition to a normal idle condition. Receiver circuit section 14 is operable to three different commands from transmitter 15. First, with a single momentary depression of the transmit button, relay 18 will be energized and, assuming normal conditions, the engine will start. When the engine begins to warm up, approimately 1–3 minutes after starting, a second, single momentary depression of the transmitter transmit button provides a current signal to terminal 87 for changing the fast idle to normal idle as previously described. A final feature of receiver circuit section 14 is that at any time the operator wishes to turn off the engine, he merely depresses and holds the transmit button for 6–8 seconds. This causes the receiver relay 14*b* to send a current signal across line 83 to switch 38. Then after approximately six seconds, switch 38 opens and the requisite ground signals (via line 37) are removed from relays 34 and 18. This shuts the system off completely until another transmitter or clock turn-on signal is received. This remote-control engine turn-off feature provides a desirable safety feature as well as a convenience feature.

Other safety features have previously been mentioned, such as, engine temperature switch 31, low oil pressure switch 29, hood safety switch 42, overspeed switches 36 and 44 and vacuum switches 35 and 63 in combination with restricter valve 74. These features mean that virtually any malfunctioning or tampering which may occur with an unattended vehicle will result in engine turn-off. This enables the operator of the vehicle to utilize starting system 10 without concerns about something going wrong and damaging the vehicle or about injuring a child or other person who may be in or near the vehicle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An automatic starting system for a vehicle which includes a starter circuit, a battery and an internal combustion engine with a throttle-gas pedal linkage, said starting system comprising:

system energizing means electrically connectable to the battery of said vehicle, said system energizing means being selectively actuatable for conducting a current signal from said battery;

a plurality of switch means designed and arranged and electrically operable to couple said current signal from said system energizing means to the starter circuit of said vehicle;

solenoid means connectable to the throttle-gas pedal linkage of said vehicle; and means for alternately energizing and deenergizing said solenoid means for a finite time interval, thereby creating a pumping action of said throttle-gas pedal linkage, said energizing and deenergizing means includes a thermal switch flasher and said plurality of switch means are cooperatively arranged with said energizing and deenergizing means such that said pumping action occurs in response to operation of said thermal switch flasher.

2. The system of claim 1 wherein said finite time interval is between three and five seconds.

3. The system of claim 1 which further includes remote-control transmitter means having circuitry of a design compatible with said system energizing means for actuation of said system energizing means, said transmitter means circuitry and said system energizing means being arranged such that said transmitter means is operable to turn off said system.

4. The system of claim 3 wherein said remote-control transmitter means being designed and arranged to generate a fast idle command signal for converting a fast idle condition of said vehicle to a normal idle condition.

5. The automatic starting system of claim 1 which further includes overspeed switch means coupled to one of said plurality of switch means, said overspeed switch means being operable to remove said battery current from said engine.

6. The system of claim 5 wherein said overspeed switch means includes a mechanical overspeed switch controllable by the throttle-gas pedal linkage of said vehicle.

7. The system of claim 5 wherein said overspeed switch means includes an electronic overspeed switch controllable by a distributor of said engine.

8. The system of claim 1 which further includes hood safety switch means electrically coupled to one of said plurality of switch means and mechanically cooperating with opening of a hood of said vehicle to remove said battery current signal from said engine.

9. The system of claim 1 which further includes a park-neutral switch coupling a portion of said automatic starting system to said starter circuit, said system further including an emergency brake switch in electrical series with said park-neutral switch.

10. The system of claim 1 wherein said plurality of switch means includes a plurality of timed, thermal switches, and wherein one of said timed, thermal switches is designed and arranged to limit the time period during which current from said battery is delivered to said starter circuit.

11. The system of claim 1 which further includes a first relay coupled directly to said system energizing means and a key switch arranged between a ground potential and said first relay and operable when closed to couple the necessary ground signal to said first relay for energizing said first relay, said first relay being operable when energized to conduct current from said system energizing means to the remainder of said automatic starting system.

12. An automatic starting system for a vehicle which includes a starter circuit, a battery and an internal combustion engine with a throttle-gas pedal linkage, said starting system comprising:

system energizing means electrically connectable to the battery of said vehicle, said system energizing means being selectively actuatable for conducting a current signal from said battery;

a plurality of switch means designed and arranged and electrically operable to couple said current signal from said system energizing means to the starter circuit of said vehicle;

solenoid means connectable to the throttle-gas pedal linkage of said vehicle;

means for alternately energizing and deenergizing said solenoid means for a finite time interval, thereby creating a pumping action of said throttle-gas pedal linkage; and means for bypassing said energizing and deenergizing means when the engine temperature of said vehicle is above a predetermined level.

13. The system of claim 12 wherein said plurality of switch means is cooperatively arranged with said energizing and deenergizing means such that said pumping action occurs prior to the coupling of said current signal to said starter circuit when said engine temperature is below said predetermined level.

14. The system of claim 13 wherein said energizing and deenergizing means includes a thermal switch flasher.

15. The system of claim 14 wherein said finite time interval is betweeen three and five seconds.

16. The system of claim 15 which further includes electronic overspeed switch means coupled to one of said plurality of switch means, said electronic overspeed switch means being controllable by a distributor of said engine, said electronic overspeed switch means being operable to remove said battery current signal from said engine.

17. The system of claim 16 which further includes hood safety switch means electrically coupled to one of said plurality of switch means and mechanically cooperating with the opening of a hood of said vehicle to remove said battery current signal from said engine.

18. The system of claim 17 wherein said plurality of switch means includes a plurality of relays and a plurality of timed, thermal switches.

19. The system of claim 18 which further includes a park-neutral switch coupling a portion of said automatic starting system to said starter circuit.

20. The system of claim 19 which further includes an emergency brake switch in electrical series with said park-neutral switch.

21. The system of claim 20 which further includes a low oil switch electrically coupled to one of said plurality of switch means and operable, when the oil pressure drops below a predetermined level, to remove said battery current signal from said engine.

22. The system of claim 21 which further includes an engine temperature switch electrically coupled to one of said plurality of switch means and operable, when the engine temperature exceeds a predetermined upper limit, to remove said battery current signal from said engine.

23. The system of claim 18 wherein one of said timed, thermal switches is designed and arranged to limit the time period during which current from said battery is delivered to said starter circuit.

24. The system of claim 23 wherein said time period during which current from said battery is delivered to said starter circuit is between nine and thirteen seconds.

25. The system of claim 18 wherein said plurality of relays includes a first relay coupled directly to said system energizing means, said first relay being operable when energized to connect current from said system energizing means to the remainder of said automatic starting system.

26. The system of claim 25 which further includes a key switch arranged between a ground potential and said first relay and operable when closed to couple the necessary ground signal to said first relay for energizing said first relay.

* * * * *